US012295454B2

(12) United States Patent
Song et al.

(10) Patent No.: US 12,295,454 B2
(45) Date of Patent: May 13, 2025

(54) LENO JACQUARD WEAVE SHOE UPPER HAVING SELECTIVE STRETCHABILITY IN SPECIFIC AREAS

(71) Applicant: Soo Bok Song, Busan (KR)

(72) Inventors: Soo Bok Song, Busan (KR); Won Seok Song, Busan (KR); Ji Hyun Song, Busan (KR); Kapsoo Hwang, Busan (KR); Sinje Park, Busan (KR)

(73) Assignee: Soo Bok Song, Busan (KR)

( * ) Notice: Subject to any disclaimer, the term of this patent is extended or adjusted under 35 U.S.C. 154(b) by 0 days.

(21) Appl. No.: 18/289,086

(22) PCT Filed: Dec. 10, 2022

(86) PCT No.: PCT/KR2022/020080
§ 371 (c)(1),
(2) Date: Oct. 31, 2023

(87) PCT Pub. No.: WO2023/158073
PCT Pub. Date: Aug. 24, 2023

(65) Prior Publication Data

US 2024/0225196 A1 Jul. 11, 2024

(30) Foreign Application Priority Data

Feb. 21, 2022 (KR) ..... 10-2022-0021920

(51) Int. Cl.
*A43B 23/02* (2006.01)
*D03D 13/00* (2006.01)
(Continued)

(52) U.S. Cl.
CPC ..... *A43B 23/0265* (2013.01); *D03D 13/006* (2013.01); *D03D 15/56* (2021.01);
(Continued)

(58) Field of Classification Search
CPC ..... A43B 23/027; A43B 23/0265
(Continued)

(56) References Cited

U.S. PATENT DOCUMENTS 10,174,447 B2 * 1/2019 Dua ..... A43B 23/026
2014/0173933 A1 6/2014 Bell
(Continued)

FOREIGN PATENT DOCUMENTS

KR 10-0340790 B1 6/2002
KR 10-1437472 B1 11/2014
(Continued)

OTHER PUBLICATIONS

International Search Report from corresponding PCT Application No. PCT/KR2022/020080, dated Mar. 23, 2023.
(Continued)

*Primary Examiner* — Timothy K Trieu
(74) *Attorney, Agent, or Firm* — Harness, Dickey & Pierce, P.L.C.

(57) ABSTRACT

The present disclosure relates to a shoe upper including a stretchable area and a non-stretchable area. The shoe upper is woven by combining a warp yarn and a weft yarn, the weft yarn includes a first weft yarn, which is a stretchable yarn, and a second weft yarn, which is a normal yarn, the first and second weft yarns being alternately arranged next to each other, in the stretchable and the non-stretchable area, the shoe upper is woven with a leno weave and a plain weave in which the first weft yarn and the second weft yarn each are combined to the warp yarn, and the number of weave points of the warp yarn and the second weft yarn is larger in the non-stretchable area than in the stretchable area.

13 Claims, 9 Drawing Sheets

(51) Int. Cl.
*D03D 15/56* (2021.01)
*D03D 19/00* (2006.01)

(52) U.S. Cl.
CPC ..... *D03D 19/00* (2013.01); *D10B 2401/061* (2013.01); *D10B 2501/043* (2013.01)

(58) Field of Classification Search
USPC ..... 36/45
See application file for complete search history.

(56) References Cited

U.S. PATENT DOCUMENTS

| | | | | |
|---|---|---|---|---|
| 2016/0309843 | A1* | 10/2016 | Song | A43B 7/06 |
| 2018/0135213 | A1* | 5/2018 | Bell | D03D 15/56 |
| 2020/0362509 | A1* | 11/2020 | Kim | D01D 5/16 |
| 2020/0375270 | A1* | 12/2020 | Holschuh | B32B 5/08 |

FOREIGN PATENT DOCUMENTS

| | | | |
|---|---|---|---|
| KR | 10-1557130 | B1 | 10/2015 |
| KR | 10-1681984 | B1 | 12/2016 |
| KR | 10-2021-0147183 | A | 12/2021 |
| KR | 10-2338867 | B1 | 12/2021 |
| KR | 10-2492236 | B1 | 1/2023 |

OTHER PUBLICATIONS

Extended European Search Report from corresponding EP Application No. 22927469.1, dated Feb. 13, 2025.

* cited by examiner

LENO JACQUARD WEAVE SHOE UPPER HAVING SELECTIVE STRETCHABILITY IN SPECIFIC AREAS

CROSS-REFERENCE TO RELATED APPLICATIONS

This application is a national phase application of PCT Application No. PCT/KR2022/020080, filed on 10 Dec. 2022, which claims the benefit and priority to Korean Patent Application No. 10-2022-0021920, filed on 21 Feb. 2022. The entire disclosures of the applications identified in this paragraph are incorporated herein by references.

BACKGROUND

Field

The present disclosure relates to a leno jacquard weave shoe upper having selective stretchability in specific areas and a shoe including the same.

Related Art

Generally, shoes include a sole which is a part that touches a ground, and a shoe upper which is combined with the sole and surrounds a foot of a wearer.

In order to improve the manufacturing convenience and manufacturing efficiency of such shoes, the shoe upper may be woven as an integral piece. Details regarding the shoe upper as integrally woven are described in Korea Patent No. 10-1437472 (Aug. 28, 2014). In addition, a heterogeneous weave fabric weaving loom and a shoe upper and shoe woven using the loom are described in Korea Patent No. 10-1557130 (Sep. 24, 2015) in detail.

In the shoe upper included in the shoe, it is necessary to provide stretchability to specific areas that require selective stretching considering protection of a foot and characteristics of a foot movement, for example, only an ankle and a toe, and it is not necessary to provide stretchability to an instep of a foot.

PATENT LITERATURE (Patent Literature 1) Korea Patent No. 10-1437472 (Aug. 28, 2014)

(Patent Literature 2) Korea Patent No. 10-1557130 (Sep. 24, 2015)

SUMMARY

The present disclosure relates to a leno-jacquard fabric woven by a heterogeneous weave fabric weaving loom or a shoe upper including the same, and an object thereof is to provide a shoe upper and a shoe including the same capable of being integrally manufactured while providing stretchability to specific areas that require selective stretching considering protection of a foot and characteristics of a foot movement, for example, only an ankle and a toe and not providing stretchability to an instep of a foot, and providing a comfortable shoe fit while having an original purpose of protecting the foot and more convenient functions when putting on and taking off the shoe.

According to an aspect of the present disclosure, there is provided a shoe upper including a stretchable area and a non-stretchable area, in which the shoe upper is woven by combining a warp yarn and a weft yarn, the weft yarn includes a first weft yarn, which is a stretchable yarn, and a second weft yarn, which is a normal yarn, the first and second weft yarns being alternately arranged next to each other, in the stretchable area and the non-stretchable area, the shoe upper is woven with a plain weave in which the first weft yarn and the second weft yarn each are combined to the warp yarn, and the number of weave points of the warp yarn and the second weft yarn is larger in the non-stretchable area than in the stretchable area.

According to another aspect of the present disclosure, there is provided a shoe upper including a stretchable area and a non-stretchable area, in which the shoe upper is woven by combining a warp yarn and a weft yarn, the weft yarn includes a first weft yarn, which is a stretchable yarn, and a second weft yarn, which is a normal yarn, the first and second weft yarns being alternately arranged next to each other, in the non-stretchable area, the shoe upper is woven with a plain weave in which the first weft yarn and the second weft yarn each are combined to the warp yarn, in the stretchable area, the warp yarn includes a first warp yarn and a second warp yarn, the first warp yarn and the second warp yarn being twisted while crossing in direction opposite to each other to form an opening, and in the stretchable area, the shoe upper is woven with a leno fabric in which the first weft yarn and the second weft yarn are combined while penetrating the opening.

The shoe upper according to the present disclosure includes the stretchable area and the non-stretchable area, and thus, it is possible to greatly improve the manufacturing process efficiency of the shoe upper by the leno-jacquard weave woven by a heterogeneous weave fabric weaving loom.

The shoe upper according to the present disclosure includes the stretchable area and the non-stretchable area, and thus, it is possible to provide a comfortable shoe fit while providing an original purpose of protecting the foot and more convenient functions when putting on and taking off the shoe.

DESCRIPTION OF EXEMPLARY EMBODIMENTS

Hereinafter, embodiments of the present disclosure will be described in detail with reference to the attached drawings.

In the present disclosure, a fabric is largely divided into a plain weave and a twisted weave.

In the present specification, the plain weave refers to a fabric made up of a warp yarn and a weft yarn perpendicularly crossing each other, and for example, a three-way weave represented by a plain weave, a twill weave, and a satin weave corresponds to this.

In the present specification, the twisted weave refers to a fabric in which the weft yarns are formed side by side, but the warp yarns are twisted by switching positions at regular intervals. For example, a leno weave in which a pair of two warp yarns is twisted while crossing each other centered on the weft yarn to form an opening and which is woven so that the weft yarn penetrates the opening corresponds to the twisted weave. In the case of the leno weave in the present specification, in the pair of two warp yarns, a first warp yarn always passes through a lower portion of the weft yarn, and a second warp yarn always passes through the upper portion of the weft yarn.

Meanwhile, generally, a warp yarn is inserted into a healed eye positioned at the center of a heald so that the warp yarn can pass through, the warp yarn passes through the healed eye, then, the warp yarn is raised and lowered by a vertical movement of the heald to form an opening between neighboring warp yarns, the weft yarn is inserted into the opening, and thus, a fabric is woven. According to a type of an opening device, the fabric can be divided into a dobby fabric in which a simple weave or a small pattern can be woven, and a jacquard fabric in which a large or complex pattern can be woven.

The dobby fabric is woven using a dobby device when a relatively small pattern is to be displayed on the fabric. Depending on the pattern, for example, a plurality of healds are respectively fixed to 20 to 40 heald frame and move up and down together, the heald movement is controlled to form the opening between the warp yarns, the weft yarn is inserted into the formed opening, and thus, the dobby fabric is woven.

In the jacquard fabric, each warp yarn is controlled by an independent heald, the heald is not fixed to the heald frame, but each heald moves up and down independently, the heald movement is controlled to form an opening between the warp yarns, the weft is inserted into the formed opening, and the fabric is woven. The jacquard fabric is woven by a jacquard loom.

In the present disclosure, a fabric or a shoe upper including a plain weave and a twisted weave can be continuously woven in a single process by a heterogeneous weave fabric weaving loom including a jacquard heald and a leno heald.

Figure 1:
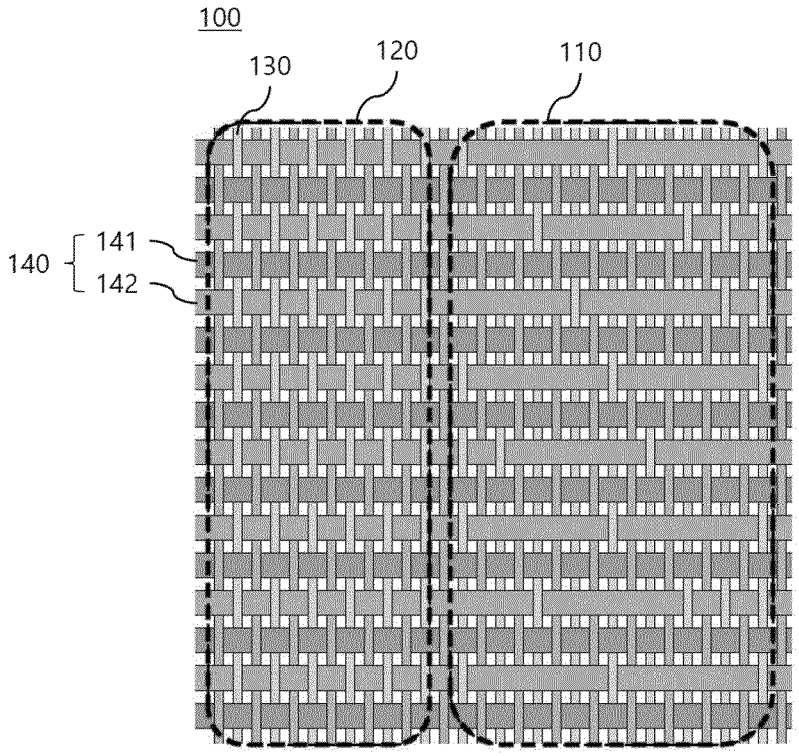
FIG. 1 is a diagram schematically illustrating a portion of a shoe upper according to one embodiment of the present disclosure.
Figure 9:
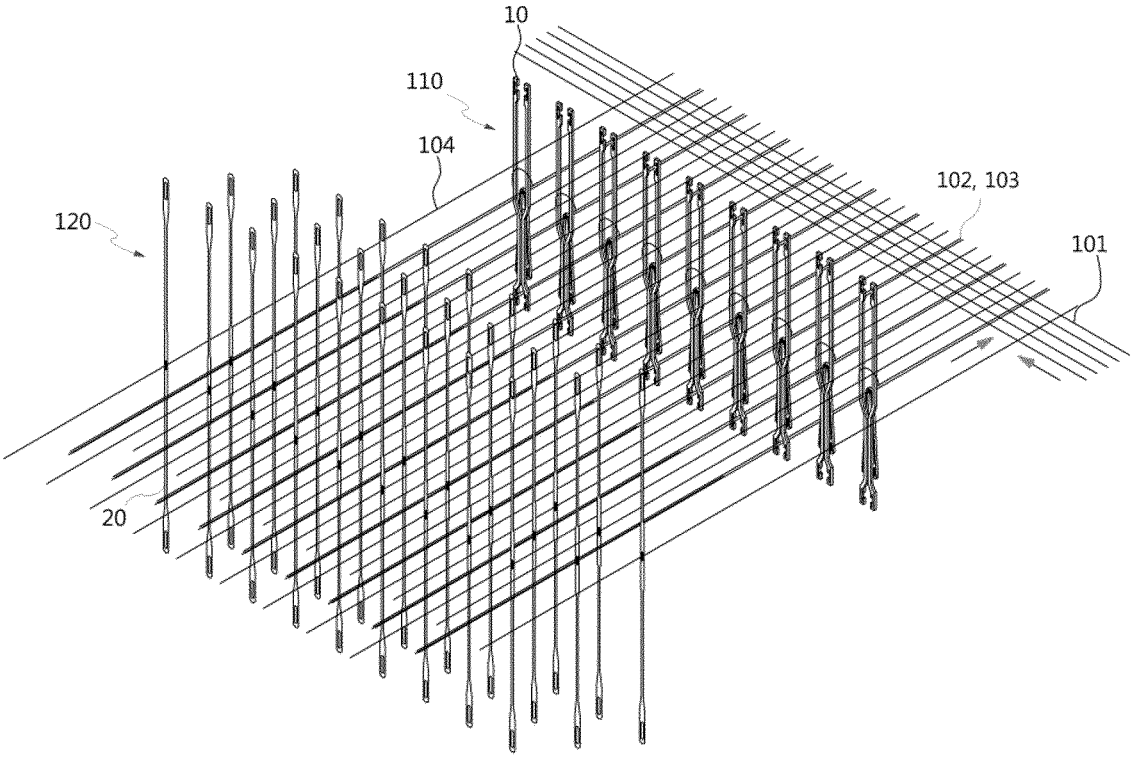
FIG. 9 illustrates FIG. 1 of Korea Patent No. 10-1557130 (Sep. 24, 2015) which is the related art.

FIG. 9 illustrates FIG. 1 of Korea Patent No. 10-1557130 (Sep. 24, 2015) which is the related art.

Referring to FIG. 9, for example, in the present disclosure, the twisted weave is woven when a leno heald 10 is operated in a heterogeneous weave fabric weaving loom, and the plain weave which is a non-twisted weave can be woven when the leno heald 10 is not operated and only a jacquard heald 20 is operated. Here, not only the jacquard heald 20 but also the leno heald 10 can control the heald movement by moving up and down independently without being fixed to the heald frame.

In this way, the fabric woven in a single process by the heterogeneous weave fabric weaving loom including the jacquard heald and leno heald is called leno-jacquard fabric in the present disclosure. Therefore, the leno-jacquard fabric according to the present disclosure may include a heterogeneous weave having the plain weave and the leno weave, only the plain weave, or only the leno weave.

FIG. 1 is a diagram schematically illustrating a portion of a shoe upper according to one embodiment of the present disclosure.

Referring to FIG. 1, a shoe upper 100 according to the present disclosure includes a stretchable area 110 and a non-stretchable area 120, and is woven by combining warp yarn 130 and weft yarn 140. The stretchable area 110 may be used in a specific area of the shoe upper that requires selective stretchability considering to protection of a foot and characteristics of foot movement, for example, in an ankle or toe area, and the non-stretchable area 120 may be used in an instep of a foot that does not require stretchability of the shoe upper.

The weft yarn 140 includes a first weft yarn 141 which is a stretchable yarn and a second weft yarn 142 which is a normal yarn, and the first weft yarn 141 and the second weft yarn 142 are arranged alternately adjacent to each other. As the stretchable yarn constituting the first weft yarn 141, for example, polyurethane stretchable yarn may be used, and as the normal yarn constituting the second weft yarn 142, for example, a normal polyester false twist yarn or a polyester regenerated yarn can be used, but the present disclosure is not limited to this.

The shoe upper 100 is woven with a plain weave in which the first weft yarn 141 and the second weft yarn 142 are combined to the warp yarn 130 in the stretchable area 110 and the non-stretchable area 120, respectively.

Here, the shoe upper is woven so that the number of the weave points of the warp yarn 130 and the second weft yarn 142 is larger in the non-stretchable area 120 than in the stretchable area 110.

In the present disclosure, the number of weave point value is a value that represents a degree to which a warp yarn and a weft yarn cross each other and participate in the weave in a fabric weave on a certain plane. When the fabric is viewed from a plane, the number of weave points is a number expressed when the warp yarn and the weft yarn cross each other in the fabric weave, with the numerator written as 1 and the number of warp yarns in the repeating unit forming the fabric weave written in the denominator. For example, in the case of the plain weave, since the number of warp yarns (1 up 1 down) in the repeating unit that constitutes the weave is 2, the weave point value of the plain weave is ½, and the plain weave has the largest weave point value and is the strongest. In addition, in the case of a four-twill weave with a four-piece weave having three up and one down, the number of weave points is ¼, and in the case of an eight-twill weave with an eight-piece weave having seven up and one down structure, the number of weave points is ⅛. Therefore, a small number of weave points value means that the weave of the fabric is loosely woven, and a large number of weave points means that the weave of the fabric is tightly woven.

Additionally, unless otherwise specified in the present disclosure, a surface of the shoe upper refers to one surface of the shoe upper that is exposed to the outside of the shoe, and a rear surface of the shoe upper refers to the other surface of the shoe upper that goes inside the shoe and is not exposed to the outside of the shoe.

FIG. 1 schematically illustrates the rear surface of the shoe upper 100.

Looking at the number of weave point values of the warp yarn 130 and the second weft yarn 142 with reference to FIG. 1, the stretchable area 110 is an eight-twill weave having seven up and one down and the number of weave points thereof is ⅛, and the non-stretchable area 120 is a plain weave having one 1 up and one down and the number of weave point value thereof is ½. Therefore, the shoe upper may be woven so that the number of weave points of the warp yarn 130 and the second weft yarn 142 is larger in the non-stretchable area 120 than in the stretchable area 110.

In this way, when a stretching weft yarn having stretchability and a normal weft yarn without stretchability are alternately arranged and combined with the warp yarn and woven, the stretchability is reduced when the weave of the fabric is made dense.

In one embodiment of the present disclosure, the first weft yarn 141 which is a stretchable yarn and the second weft yarn 142 which is a normal yarn are alternately arranged adjacent to each other to be combined with warp yarn, the combined weave of the first weft yarn 141 which is the stretchable yarn and the warp yarn is woven to be same in the stretchable area 110 and the non-stretchable area 120, and the combined weave of the second weft yarn 142 which is the normal yarn and the warp yarn is woven to be denser in the non-stretchable area 120 than in the stretchable area 110.

Accordingly, in the densely woven non-stretchable area 120, although the first weft yarn 141 which is the stretchable yarn participates in the combining of the fabric, the second weft yarn 142 which is a normal yarn densely participates in the combining, thereby reducing stretchability.

Meanwhile, in the stretchable area 110, sine the second weft yarn 142 which is the normal yarn participates in the combining relatively sparsely, the stretchability of the fabric by the first weft yarn 141 which is the stretchable yarn can be maintained.

Figure 2:
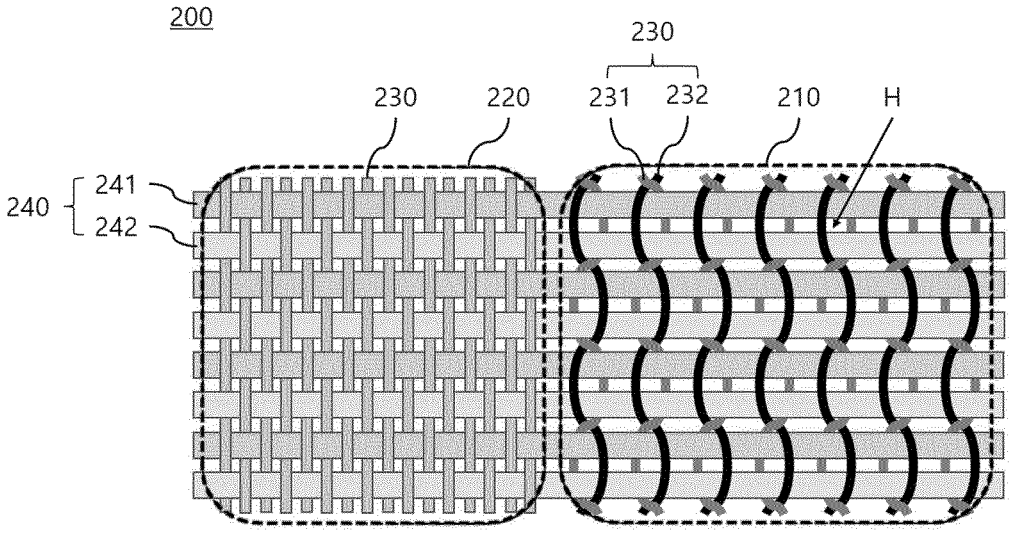
FIG. 2 is a diagram schematically illustrating a portion of a shoe upper according to another embodiment of the present disclosure.

FIG. 2 is a diagram schematically illustrating a portion of a shoe upper according to another embodiment of the present disclosure. FIG. 2 schematically illustrates the surface of the shoe upper 200.

Referring to FIG. 2, the shoe upper 200 according to the present disclosure includes a stretchable area 210 and a non-stretchable area 220, and is woven by combining a warp yarn 230 and a weft yarn 240.

The weft yarn 240 includes a first weft yarn 241 which is a stretchable yarn and a second weft yarn 242 which is a normal yarn, the first weft yarn and the second weft yarn are arranged alternately adjacent to each other. The first weft yarn 241 and the second weft yarn 242 are the same as those described with reference to FIG. 1.

The shoe upper 200 is woven with a plain weave in which the first weft yarn 241 and the second weft yarn 242 are combined to a warp yarn 230 in the non-stretchable area 220, respectively.

Meanwhile, in the stretchable area 210, the warp yarn 230 includes the first warp yarn 231 and the second warp yarn 232, and the first warp yarn 231 and the second warp yarn 232 are twisted while crossing each other in directions opposite to each other to form an opening H. Here, the shoe upper 200 is woven with a leno weave in which the first weft yarn 241 and the second weft yarn 242 are combined while penetrating the opening.

According to this configuration, the combined weave of the non-stretchable area 220 is configured densely with the plain weave, which reduces stretchability, the combined weave of the stretchable area 210 is configured to sparsely with the leno weave, and thus, the stretchability of the fabric by the first weft yarn 241 which is the stretchable yarn can be maintained.

Since the stretchable area 210 is configured of the leno weave, that is, the first warp yarn 231 and the second warp yarn 232 are twisted in directions opposite to each other to wrap and fix the weft yarn, even when the stretchable area 210 extends and contracts, the shape of the shoe upper can be firmly maintained without slippage or twisting of the weave.

Figure 3:
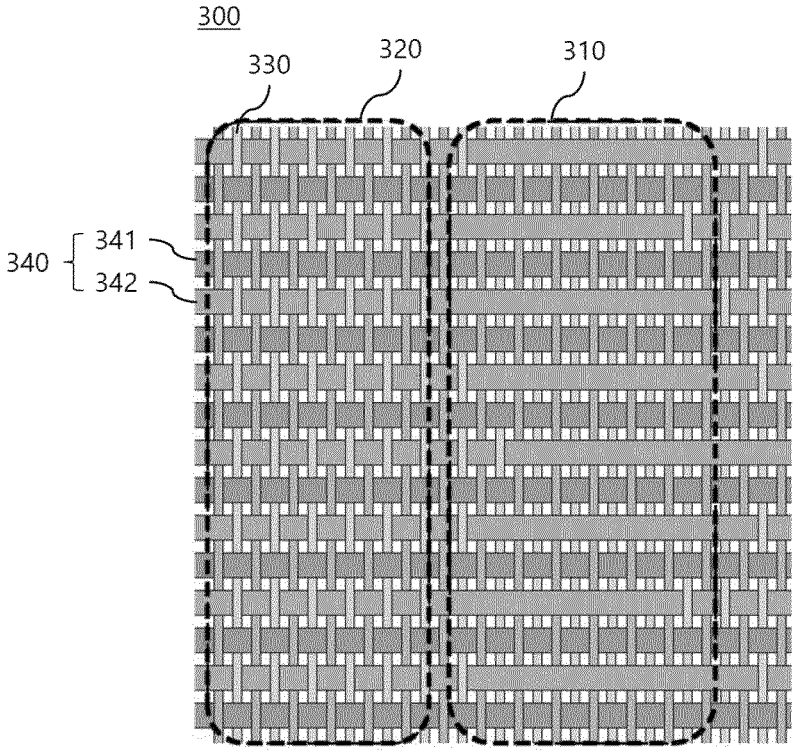
FIGS. 3 and 4 are diagrams schematically illustrating a portion of a shoe upper according to another embodiment of the present disclosure, respectively.
Figure 4:
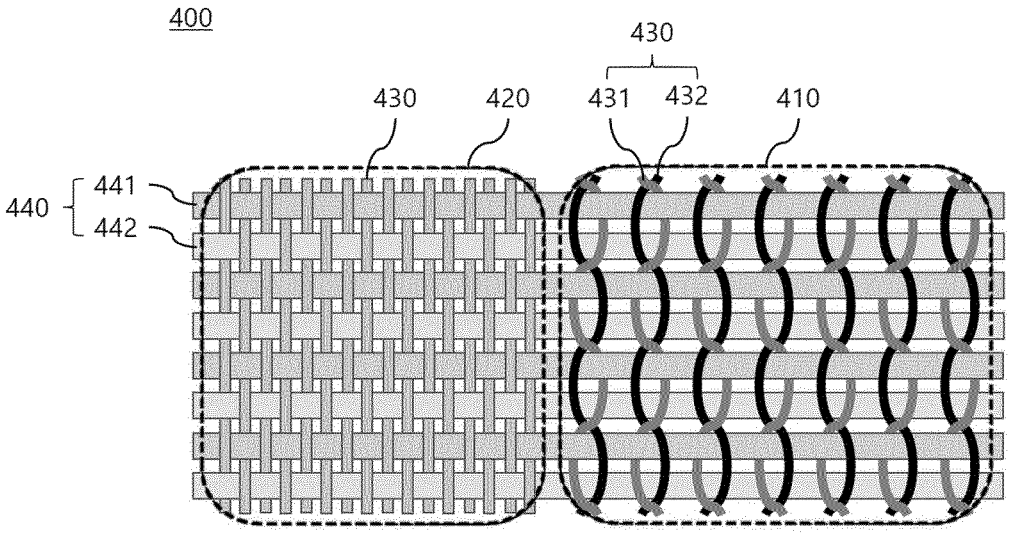

FIGS. 3 and 4 are diagrams schematically illustrating a portion of a shoe upper according to another embodiment of the present disclosure, respectively.

Referring to FIGS. 3 and 4, in shoe uppers 300 and 400 according to another embodiment of the present disclosure, second weft yarns 342 and 442 participate in the combining of the shoe upper in non-stretchable areas 320 and 420, and do not participate in the combining of the shoe upper and are floated into the rear surface of the shoe upper in the stretchable areas 310 and 410.

FIG. 3 schematically illustrates the rear surface of the shoe upper 100, similar to FIG. 1.

In FIG. 3, the second weft yarn 342 which is the normal yarn participates in the combining of the shoe upper in the non-stretchable area 320, and does not participate in the combining of the shoe upper and is floated into the rear surface of the shoe upper in the stretchable area 310.

FIG. 4 schematically illustrates the surface of the shoe upper 400.

In FIG. 4, the second weft yarn 442 which is a normal yarn participates in the combining of the shoe upper in the non-stretchable area 420, and does not participate in the combining of the shoe upper and is floated into the rear surface of the shoe upper in the stretchable area 410.

According this configuration, non-stretchable areas 320 and 420 are densely configured by the second weft yarns 342 and 442 of which the combined weave is the normal yarn, and in the stretchable areas 310 and 410, since only the first weft yarns 341 and 441 which are stretchable yarns are combined with the warp yarn, and thus, the stretchability of the fabric can be maximized by the first weft yarns 341 and 441 which are stretchable yarns.

In a shoe upper according to another embodiment of the present disclosure, the length of the second weft yarn separating from the rear surface of the shoe upper in the stretchable area is equal to or longer than the length of the first weft yarn when the first weft yarn stretches to its maximum extent.

Referring to FIGS. 3 and 4, the stretchability of the shoe upper in the stretchable areas 310 and 410 is implemented by the stretchability of the first weft yarns 341 and 441. In this case, the lengths of the second weft yarns 342 and 442 floated into the rear surface of the shoe upper in the stretchable areas 310 and 410 are longer than or at least equal to the lengths of the first weft yarns 341 and 441 when the first weft yarns 341 and 441 stretch to their maximum, and thus, it is possible to maximize the stretchability of the stretchable areas 310 and 410. When the lengths of the second weft yarns 342 and 442 separating from the rear surface of the shoe upper are shorter than the lengths of the first weft yarns 341 and 441 when the first weft yarns 341 and 441 stretch to their maximum, a problem may occur in which the first weft yarns 341 and 441 cannot be stretched to their maximum due to the second weft yarns 342 and 442.

Figure 5:
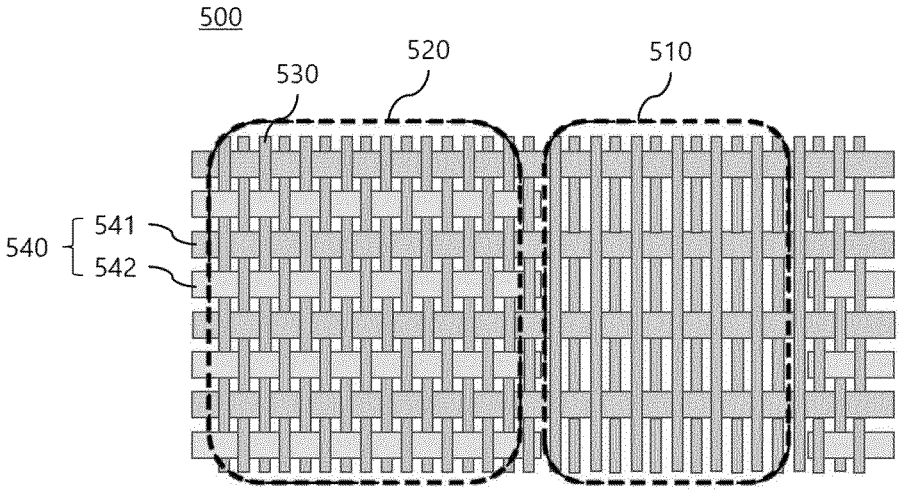
FIGS. 5 and 6 are diagrams schematically illustrating a portion of a shoe upper according to another embodiment of the present disclosure, respectively.
Figure 6:
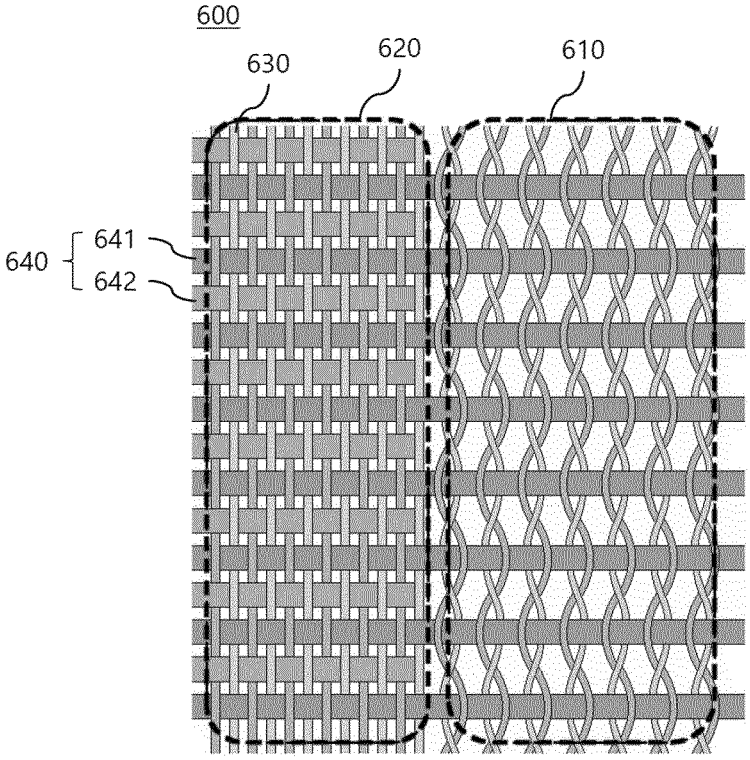

FIGS. 5 and 6 are diagrams schematically illustrating a portion of a shoe upper according to another embodiment of the present disclosure, respectively.

Referring to FIGS. 5 and 6, in shoe uppers 500 and 600 according to another embodiment of the present disclosure, the second weft yarns 542 and 642 separating from the rear surface of the shoe upper are cut from the rear surface of the shoe upper.

In FIG. 5, the second weft yarn 542 participates in combining the shoe upper in the non-stretchable area 520, and is cut from the rear surface of the shoe upper in the stretchable area 510.

In FIG. 6, the second weft yarn 642 participates in combining the shoe upper in the non-stretchable area 620, and is cut from the rear surface of the shoe upper in the stretchable area 610.

According to this configuration, non-stretchable areas 520 and 620 are densely configured by the second weft yarns 542 and 642 of which the combined weave is the normal yarn, and in the stretchable areas 310 and 410, since only the first weft yarns 541 and 641 which are stretchable yarns are combined with the warp yarn and the second yarns 542 and 642 which are the normal yarns are cut, and thus, the stretchability of the fabric can be maximized by the first weft yarns 341 and 441 which are stretchable yarns.

Figure 7:
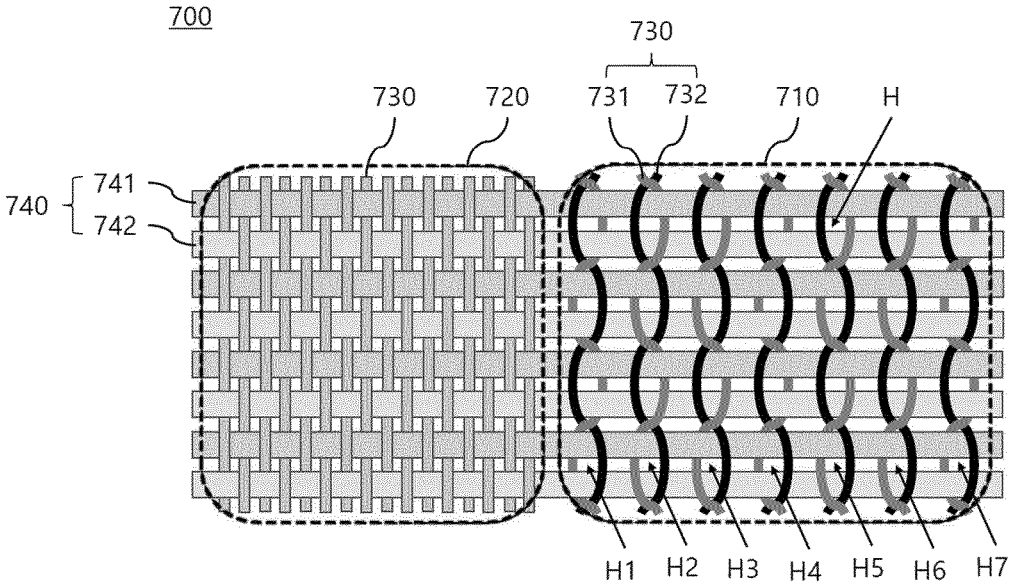
FIG. 7 is a diagram schematically illustrating a portion of a shoe upper according to another embodiment of the present disclosure.

FIG. 7 is a diagram schematically illustrating a portion of a shoe upper according to another embodiment of the present disclosure.

Referring to FIG. 7, in a shoe upper 700 according to another embodiment of the present disclosure, in the stretchable area 710, the number of openings H through which the first weft yarn 741 penetrates is more than the number of openings H through which the second weft yarn 742 penetrates.

Described in more detail with reference to FIG. 7, in the stretchable area 710, the first weft yarn 741 penetrates seven openings (H1 to H7), and the second weft yarn 742 penetrates three openings (H1, H4, and H7). According to this configuration, the stretchable area (710) is densely combined by the first weft yarn 741 which is the stretchable yarn and combined sparsely by the second weft yarn 742 which is a normal yarn. Therefore, the stretchability of the first weft yarn 741 which is the stretchable yarn can be effectively implemented in the shoe upper.

Figure 8:
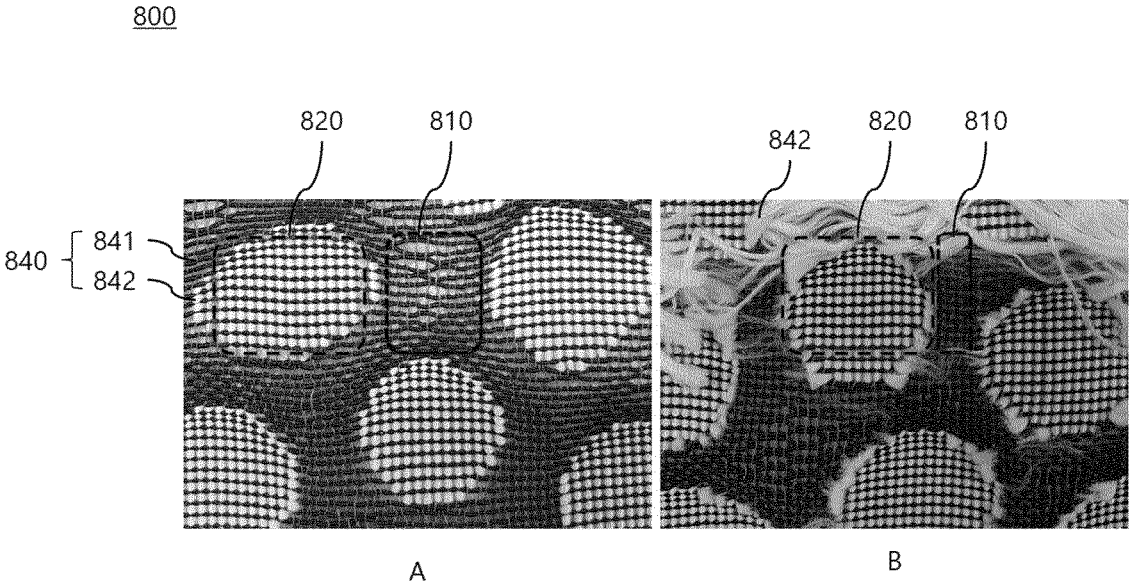
FIG. 8 is a diagram illustrating a photograph of a portion of a shoe upper according to another embodiment of the present disclosure.

FIG. 8 is a diagram illustrating a photograph of a portion of a shoe upper according to another embodiment of the present disclosure.

Referring to FIG. 8, in a shoe upper 800 according to another embodiment of the present disclosure, a stretchable area 810 and a non-stretchable area 820 are woven continuously in a single process by a heterogeneous weave fabric weaving loom including a leno heald and a jacquard heald.

Described in more detail with reference to FIG. 8, A in FIG. 8 is a diagram schematically illustrating a surface of the shoe upper 800, and B in FIG. 8 is a diagram schematically illustrating a rear surface of the shoe upper 800. The shoe upper 800 includes the stretchable area (810) and the non-stretchable area 820, where the stretchable area 810 is configured of a leno weave and the non-stretchable area 820 is configured of a plain weave. However, the present is not limited to this, and for example, the stretchable area 810 may be configured of a plain weave.

The shoe upper 800 can be continuously woven in a single process by the heterogeneous weave fabric weaving loom including the leno heald and the jacquard heald, not only when the shoe upper is configured of only the plain weave, but also when the shoe upper is configured to a heterogeneous weave of the plain weave and the leno weave.

FIG. 8 exemplarily presents the shoe upper 800 including the stretchable area 810 configured of the leno weave and the non-stretchable area 820 configured of the plain weave, and as described above, the shoe upper 800 can be continuously woven in a single process by the heterogeneous weave fabric weaving loom without the need for a separate sewing process.

In a shoe upper according to another embodiment of the present disclosure, the warp yarn is configured of a heat fusion yarn.

As the warp yarn is configured of the heat fusion yarn, in an area of the shoe upper woven with the plain weave, the warp yarn is fused with the weft yarn by heat, and in an area of the shoe upper woven with the leno weave of the shoe upper, the warp yarn is fused with the weft yarn by heat, and the first warp yarn and the second warp yarn twisted in directions opposite to each other can be fused to each other by heat.

The warp yarn configured of the heat fusion yarn in a non-stretchable area is fused by heat not only to the first weft yarn, which is the stretchable yarn, but also to the second weft yarn, which is the normal yarn, and thus, it is possible to increase effect of reducing stretchability.

Meanwhile, the warp yarn configured of heat fusion yarn in the stretchable area is fused by heat to the first weft yarn which is a stretchable yarn, and thus, even though the second weft yarn which is a normal yarn participates sparsely in the weaving, it is possible to firmly fix the woven weave and prevent slippage or twisting of the weave.

In addition, even when the second weft yarn which is a normal yarn is cut, the remaining second weft yarn is fused to the warp yarn by heat, thereby preventing unraveling, slippage, or twisting of the second weft yarn.

According to another embodiment of the present disclosure may, it is possible to provide a shoe manufactured with the shoe upper in accordance with the present disclosure.

Thereafter, various embodiments of the present disclosure will be described.

(1) A shoe upper comprising a stretchable area and a non-stretchable area, wherein the shoe upper is woven by combining a warp yarn and a weft yarn, the weft yarn includes a first weft yarn, which is a stretchable yarn, and a second weft yarn, which is a normal yarn, the first and second weft yarns being alternately arranged next to each other, in the stretchable area and the non-stretchable area, the shoe upper is woven with a plain weave in which the first weft yarn and the second weft yarn each are combined to the warp yarn, and the number of weave points of the warp yarn and the second weft yarn is larger in the non-stretchable area than in the stretchable area.

(2) A shoe upper comprising a stretchable area and a non-stretchable area, wherein the shoe upper is woven by combining a warp yarn and a weft yarn, the weft yarn includes a first weft yarn, which is a stretchable yarn, and a second weft yarn, which is a normal yarn, the first and second weft yarns being alternately arranged next to each other, in the non-stretchable area, the shoe upper is woven with a plain weave in which the first weft yarn and the second weft yarn each are combined to the warp yarn, in the stretchable area, the warp yarn includes a first warp yarn and a second warp yarn, the first warp yarn and the second warp yarn being twisted while crossing in direction opposite to each other to form an opening, and in the stretchable area, the shoe upper is woven with a leno fabric in which the first weft yarn and the second weft yarn are combined while penetrating the opening.

(3) The shoe upper wherein a second weft yarn participates in combining of the shoe upper in a non-stretchable area, and does not participate the combining of the shoe upper and is configured to be floated into a rear surface of the shoe upper in a stretchable area.

(4) The shoe upper wherein in the stretchable area, a length of the second weft yarn floated into the rear surface of the shoe upper is equal to or longer than a length when the first weft yarn stretches to the maximum thereof.

(5) The shoe upper wherein a second weft yarn floated into a rear surface of the shoe upper is cut from the rear surface of the shoe upper.

(6) The shoe upper wherein in a stretchable area, the number of openings through which a first weft yarn penetrates is greater than the number of openings through which a second weft yarn penetrates.

(7) The shoe upper wherein a stretchable area and a non-stretchable area are woven continuously in a single process by a heterogeneous weave fabric weaving loom including a leno heald and a jacquard heald.

(8) The shoe upper wherein a warp yarn includes a heat fusion yarn.

EXPLANATION OF SYMBOLS

100, 200, 300, 400, 500, 600, 700, 800: shoe upper
110, 210, 310, 410, 510, 610, 710, 810: stretchable area
120, 220, 320, 420, 520, 620, 720, 820: non-stretchable area
130, 230, 330, 430, 530, 630, 730: warp yarn
231, 431, 731: first warp yarn
232, 432, 732: second warp yarn
140, 240, 340, 440, 540, 640, 740, 840: weft yarn
141, 241, 341, 441, 541, 641, 741, 841: first weft yarn
142, 242, 342, 442, 542, 642, 742, 842: second weft yarn
H: opening

What is claimed is:

1. A shoe upper comprising a stretchable area and a non-stretchable area, wherein the shoe upper is woven by combining a warp yarn and a weft yarn, wherein the weft yarn includes a first weft yarn, which is a stretchable yarn, and a second weft yarn, which is a normal yarn, the first and second weft yarns being alternately arranged next to each other, wherein the stretchable area and the non-stretchable area of the shoe upper is woven with a plain weave in which the first weft yarn and the second weft yarn each are combined to the warp yarn, and wherein a number of weave points of the warp yarn and the second weft yarn is larger in the non-stretchable area than in the stretchable area, and wherein the second weft yarn participates in combining of the shoe upper in the non-stretchable area, does not participate the combining of the shoe upper in the stretchable area, and is configured to be floated into a rear surface of the shoe upper in the stretchable area.

2. The shoe upper of claim 1, wherein a length of the second weft yarn of the stretchable area floated into the rear surface of the shoe upper is equal to or longer than a length when the first weft yarn stretches to the maximum thereof.

3. The shoe upper of claim 1, wherein the second weft yarn floated into the rear surface of the shoe upper is cut from the rear surface of the shoe upper.

4. The shoe upper of claim 1, wherein the stretchable area and the non-stretchable area are woven continuously in a single process by a heterogeneous weave fabric weaving loom including a leno heald and a jacquard heald.

5. The shoe upper of claim 1, wherein the warp yarn includes a heat fusion yarn.

6. A shoe upper comprising a stretchable area and a non-stretchable area, wherein the shoe upper is woven by combining a warp yarn and a weft yarn, wherein the weft yarn includes a first weft yarn, which is a stretchable yarn, and a second weft yarn, which is a normal yarn, the first and second weft yarns being alternately arranged next to each other, wherein the non-stretchable area of the shoe upper is woven with a plain weave in which the first weft yarn and the second weft yarn each are combined to the warp yarn, wherein the warp yarn of the stretchable area includes a first warp yarn and a second warp yarn, the first warp yarn and the second warp yarn being twisted while crossing in direction opposite to each other to form an opening, and wherein the stretchable area of the shoe upper is woven with a leno fabric in which the first weft yarn and the second weft yarn are combined while penetrating the opening, and wherein the second weft yarn participates in combining of the shoe upper in the non-stretchable area, does not participate the combining of the shoe upper in the stretchable area, and is configured to be floated into a rear surface of the shoe upper in the stretchable area.

7. The shoe upper of claim 6, wherein in a length of the second weft yarn of the stretchable area floated into the rear surface of the shoe upper is equal to or longer than a length when the first weft yarn stretches to the maximum thereof.

8. The shoe upper of claim 6, wherein the second weft yarn floated into the rear surface of the shoe upper is cut from the rear surface of the shoe upper.

9. The shoe upper of claim 6, wherein the stretchable area and the non-stretchable area are woven continuously in a single process by a heterogeneous weave fabric weaving loom including a leno heald and a jacquard heald.

10. The shoe upper of claim 6, wherein the warp yarn includes a heat fusion yarn.

11. A shoe upper comprising a stretchable area and anon-stretchable area, wherein the shoe upper is woven by combining a warp yarn and a weft yarn, wherein the weft yarn includes a first weft yarn, which is a stretchable yarn, and a second weft yarn, which is a normal yarn, the first and second weft yarns being alternately arranged next to each other, wherein the non-stretchable area of the shoe upper is woven with a plain weave in which the first weft yarn and the second weft yarn each are combined to the warp yarn, wherein the warp yarn of the stretchable area includes a first warp yarn and a second warp yarn, the first warp yarn and the second warp yarn being twisted while crossing in direction opposite to each other to form an opening, and wherein the stretchable area of the shoe upper is woven with a leno fabric in which the first weft yarn and the second weft yarn are combined while penetrating the opening, wherein a number of an opening of the stretchable area through which the first weft yarn penetrates is greater than the number of openings through which the second weft yarn penetrates.

12. The shoe upper of claim 11, wherein the stretchable area and the non-stretchable area are woven continuously in a single process by a heterogeneous weave fabric weaving loom including a leno heald and a jacquard heald.

13. The shoe upper of claim 11, wherein the warp yarn includes a heat fusion yarn.

* * * * *